US008081135B2

(12) United States Patent
Pintos et al.

(10) Patent No.: US 8,081,135 B2
(45) Date of Patent: Dec. 20, 2011

(54) ANTENNA ARRAYS WITH DUAL CIRCULAR POLARIZATION

(75) Inventors: Jean-Francois Pintos, Bourgbarre (FR); Philippe Minard, Saint Medard sur Ille (FR); Philippe Chambelin, Chateaugiron (FR)

(73) Assignee: Thomson Licensing, Boulogne-Billancourt (FR)

( * ) Notice: Subject to any disclaimer, the term of this patent is extended or adjusted under 35 U.S.C. 154(b) by 353 days.

(21) Appl. No.: 12/094,627

(22) PCT Filed: Nov. 20, 2006

(86) PCT No.: PCT/EP2006/068687

§ 371 (c)(1),
(2), (4) Date: Jan. 16, 2009

(87) PCT Pub. No.: WO2007/060148

PCT Pub. Date: May 31, 2007

(65) Prior Publication Data

US 2009/0219219 A1 Sep. 3, 2009

(30) Foreign Application Priority Data

Nov. 24, 2005 (FR) ..... 05 53592

(51) Int. Cl.
*H01Q 21/00* (2006.01)

(52) U.S. Cl. ..... 343/853; 343/700 MS

(58) Field of Classification Search ..... 343/853, 343/856, 700 MS

See application file for complete search history.

(56) References Cited

U.S. PATENT DOCUMENTS

| | | | | |
|---|---|---|---|---|
| 5,223,848 | A * | 6/1993 | Rammos et al. | 343/700 MS |
| 5,661,494 | A * | 8/1997 | Bondyopadhyay | 343/700 MS |
| 6,362,788 | B1 | 3/2002 | Louzir | |
| 6,618,012 | B1 | 9/2003 | Louzir et al. | |
| 2002/0018018 | A1 | 2/2002 | Fathy et al. | |

FOREIGN PATENT DOCUMENTS

| | | |
|---|---|---|
| EP | 1162689 | 12/2001 |
| FR | 2821489 | 8/2002 |
| JP | 60/18004 | 6/1985 |
| WO | WO 00/79649 | 12/2000 |

OTHER PUBLICATIONS

Patent Abstracts of Japan, vol. 009, No. 131, Jun. 6, 1985 & JP 60-018004.
Search Report Dated Feb. 9, 2007.

* cited by examiner

*Primary Examiner* — Dieu H. Duong
(74) *Attorney, Agent, or Firm* — Robert D. Shedd; Jeffrey M. Navon

(57) ABSTRACT

The invention consists of an antenna array, for the reception of two frequency bands, comprising two pairs of radiating elements and an network for excitation of these elements for the reception of one of the bands. The radiating elements are positioned so as to free the center of the array to allow colocalized reception of the other band. The excitation network comprises hybrid elements so as to introduce a certain phase shift between the radiating elements allowing a dual circular polarization. This network must comply with two constraints: The phase shift introduced between the hybrids must be equal to the phase shift of the hybrid modulo 2kπ.k integer. and the length of the line L1 placed between the first hybrid H1 and the first patch PA1 is such that it introduces a phase shift equal to π modulo 2kπ.k integer.

2 Claims, 6 Drawing Sheets

ANTENNA ARRAYS WITH DUAL CIRCULAR POLARIZATION

This application claims the benefit, under 35 U.S.C. §365 of International Application PCT/EP2006/068687, filed Nov. 20, 2006, which was published in accordance with PCT Article 21(2) on May 31, 2007 in English and which claims the benefit of French patent application No. 0553592, filed Nov. 24, 2005.

The present invention pertains to a dual circular polarization antenna array and more particularly to an antenna array able to transmit and receive signals in various frequency bands such as in particular in the K/Ka band (20/30 GHz for Internet service), and the Ku band (10/15 GHz for TV reception). Satellite links make it possible to cover vast geographical expanses without the investment both for the operator and for the user being prohibitive. One of the major issues for the economic viability of the system consists in fabricating a low-cost user terminal which makes it possible to comply with all the specifications.

In order to increase the number of functionality and consequently to render the product more attractive, the user terminal must allow access to high-speed Internet as well as to conventional TV reception services. The user terminal is composed of an indoor unit or IDU which is the unit for monitoring and interface with the user, and of an outdoor unit ODU which makes it possible to convey the signals between the satellite(s) and the IDU. This ODU is composed in particular of an antenna system based on a reflector system as well as one or more sources placed at the focus (foci) of the reflector.

The fact of having multiple services, imposes frequency bands and transmit and receive polarizations that differ from the system viewpoint. The management of these various configurations impacts directly on the source(s) placed at the focus (foci) of the reflector.

In this context, the source will have to be able to transmit and receive signals in particular in the K/Ka frequency bands (20/30 GHz for Internet service), as well as receive the conventional signals in the Ku bands (10/15 GHz for TV reception).

In order to optimize the satellite capacity it can be chosen to have the satellites in the Ka band and in the Ku band at the same orbital position. The difficulty then transfers over to the antenna system which has to receive at the same focal point the Ku and Ka signals.

To solve this problem, the invention proposes a colocalized multipolarization and multiband source. It is based on a centered K/Ka source and an array of Ku band radiating elements placed round about.

But the mechanical as well as radioelectric constraints are extremely severe. On the one hand because it is necessary to leave physical room at the center of the array for the K/Ka source, and on the other hand because it is necessary to comply with the radioelectric specifications.

Figure 1:
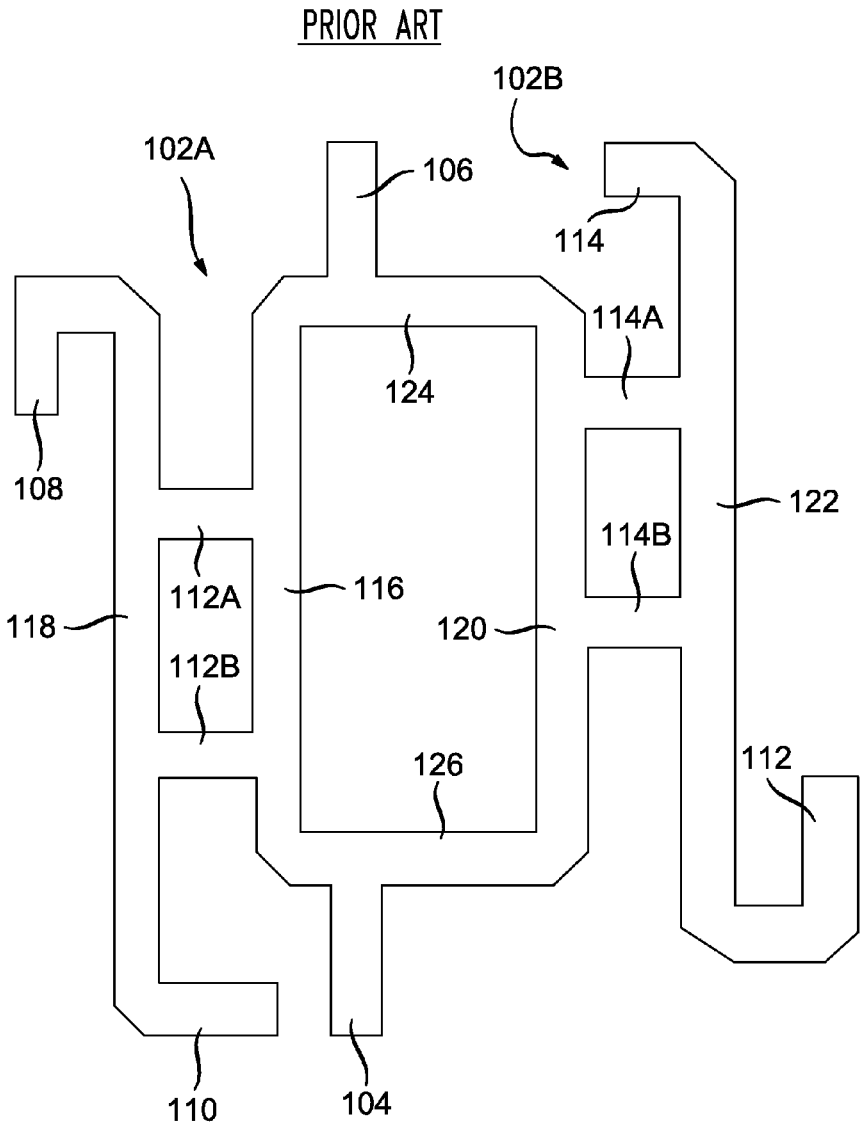

An antenna array with circular polarization and its excitation network (feeding network) are known from American patent No. U.S. 2002/0018018 A1. The proposed excitation network for this antenna with circular polarization is represented by FIG. 1. It allows the distribution of an RF signal to an array of 4 antenna elements in such a way that a right polarized signal and a left polarized signal can be sent or received by/from the system of antennas. It comprises 2 input ports 104, 106 and 4 output ports 108, 110, 112, 114. This excitation network is formed by coupler elements 102*a*, 102*b* formed of connection lines 116, 120 connected to the distribution lines 118, 122 by lines 112*a*, 112*b*, 114*a*, 114*b*. The connection lines are linked together by the lines 124, 126. The input ports 106 and 104 are linked to the lines 124 and 126 respectively and each output port 108, 110, 112 and 114 is coupled by a slot to an antenna element comprising a radiating element (known as a patch). Unfortunately this system does not make it possible to comply with the mechanical constraints demanded by colocalized, possibly multiband, sources. Specifically the excitation network is placed in the middle of the structure, which does not make it possible to have room available for a second K/Ka source at the center of this structure.

Moreover the invention relates to an array of Ku band radiating elements whose radioelectric constraints require that the source is capable of receiving dual circular polarization over a very wide band (11.7→12.7 GHz). The quality of the circular polarization being defined by its ellipticity ratio AR (or Axial Ratio), an AR of less than 1.74 dB is imposed so as to be able to correctly discriminate the two circular polarizations on the various ports.

It is known to the person skilled in the art that an infinite AR defines a perfect linear polarization and a zero AR defines a perfect circular polarization.

The invention is aimed at remedying these drawbacks.

The invention consists of an antenna array, allowing the reception of multi frequency bands, comprising two pairs of radiating elements and an network for excitation of these elements for the reception of one of the bands. The radiating elements are positioned so as to free the center of the array to allow colocalized reception of an other band and the network comprises:

- a first hybrid coupler whose outputs are linked respectively to the ports of each element of the first pair of radiating elements and make it possible to generate a phase shift $\phi$ between the ports of these elements;
- a second hybrid coupler whose outputs are linked respectively to the ports of each element of the second pair of radiating elements and make it possible to generate a phase shift $\phi$ between the ports of these elements;
- a first phase shifter making it possible to generate a phase shift $\phi$ between the first inputs of the hybrid couplers equal to the phase shift $\phi$ modulo $k\pi$, k integer, introduced by the hybrid couplers;
- a second phase shifter making it possible to generate a phase shift $\phi$ between the second inputs of the hybrid couplers equal to the phase shift $\phi$ modulo $k\pi$, k integer, introduced by the hybrid couplers;
- a phase shift element with phase shift equal to $\pi$ inserted between the port of the first radiating element and the associated output of the hybrid coupler, introducing a phase shift equal to $\pi$ modulo $k\pi$, k integer, between these two ports and allowing a dual circular polarization.

The invention has the advantage of complying at one and the same time with the mechanical and radioelectric constraints.

Preferably, the phase shift $\phi$ introduced by the hybrid couplers is a phase shift of 90° and the phase shift element consists of a length of line of length such that it introduces a phase shift of $\pi$ modulo $k\pi$, k integer.

In an embodiment, the frequency bands received are different frequency bands.

In an embodiment, the colocalized reception of the other band is done with the aid of another antenna.

Preferably, the antenna array is characterized in that the two frequency bands of the antenna array are the KU and KA bands.

Figure 2A:
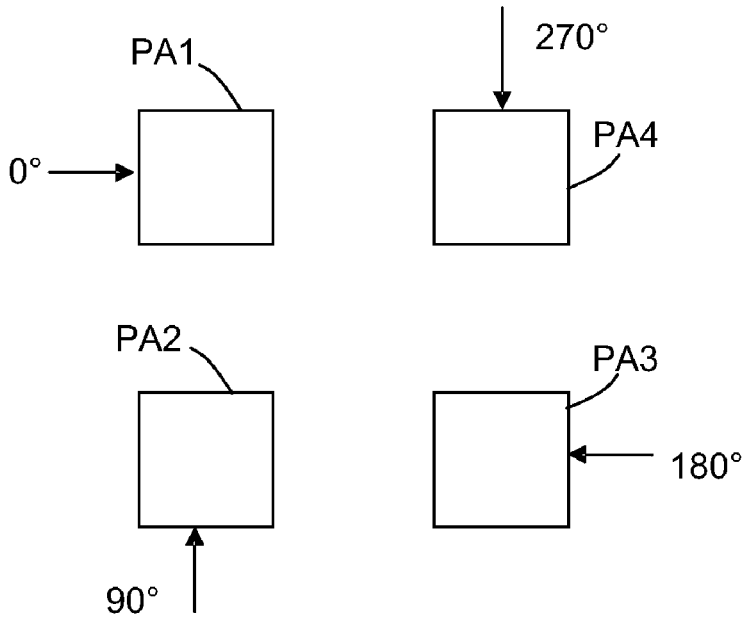
Figure 2B:
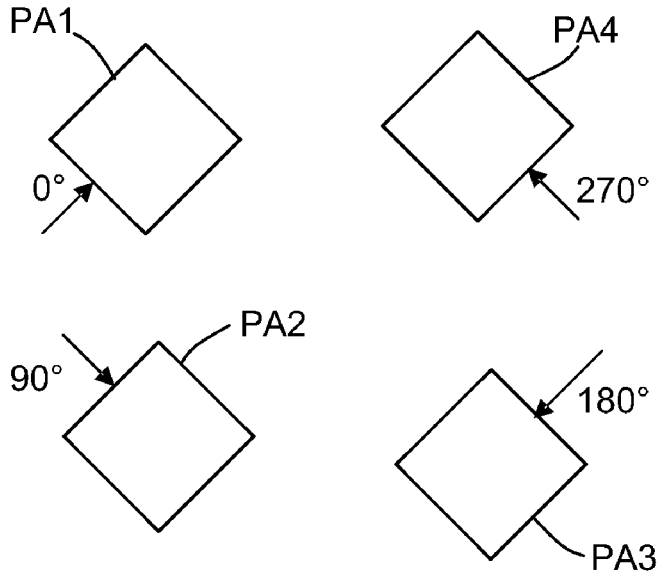
Figure 2C:
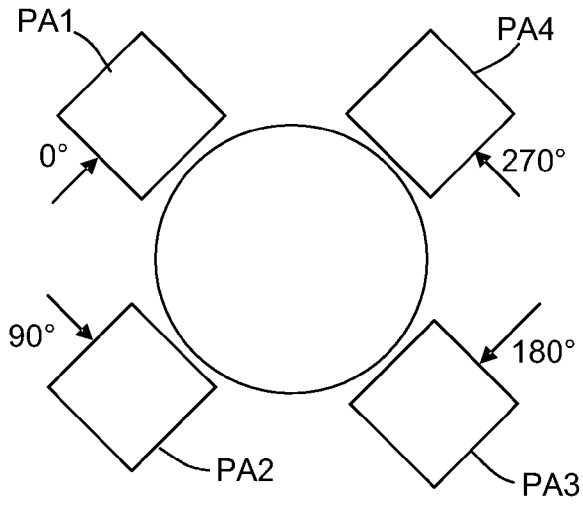
Figure 3:
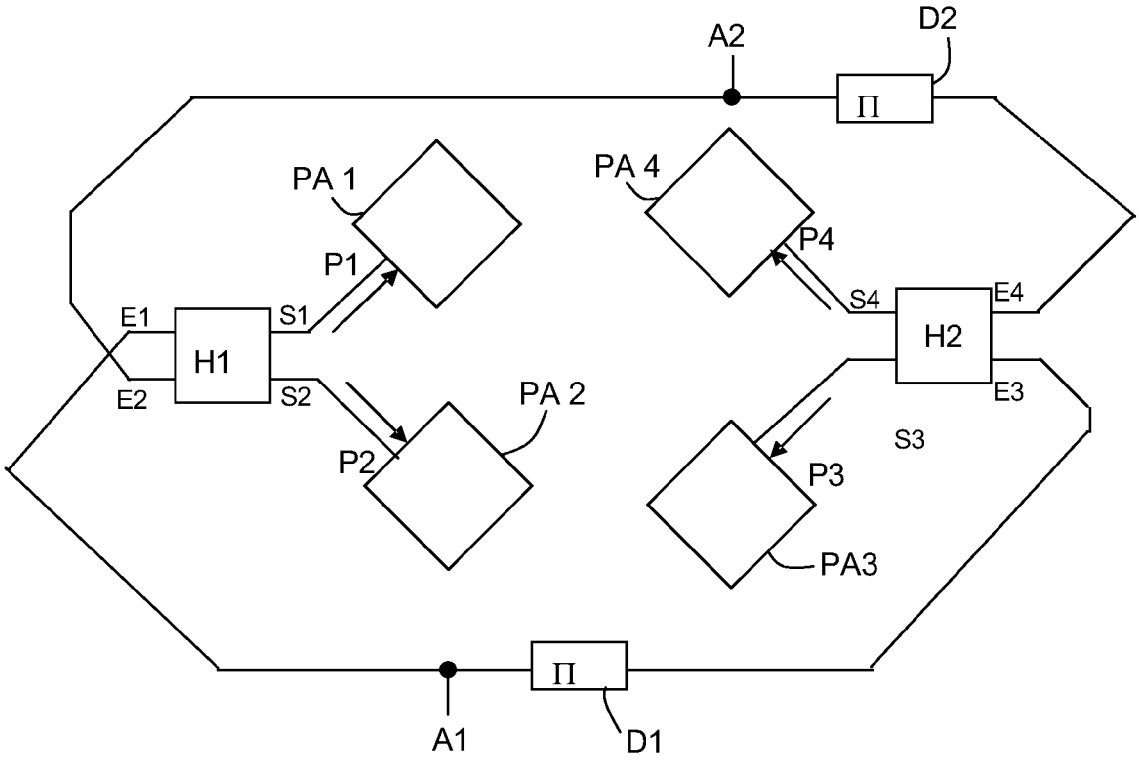
Figure 4A:
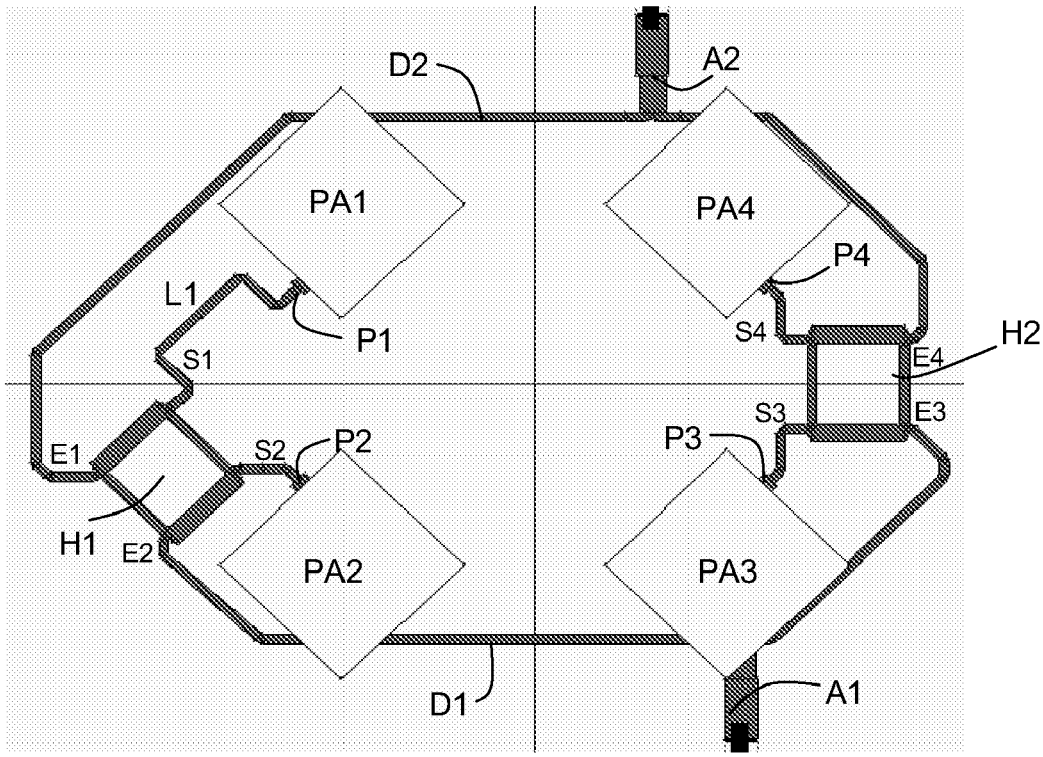
Figure 5:
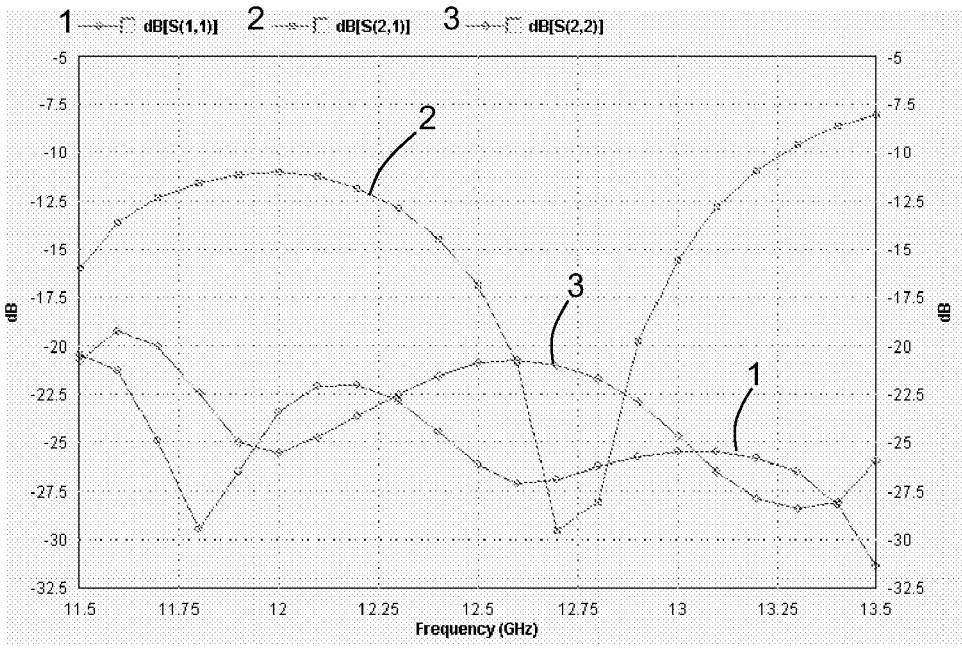
Figure 4B:
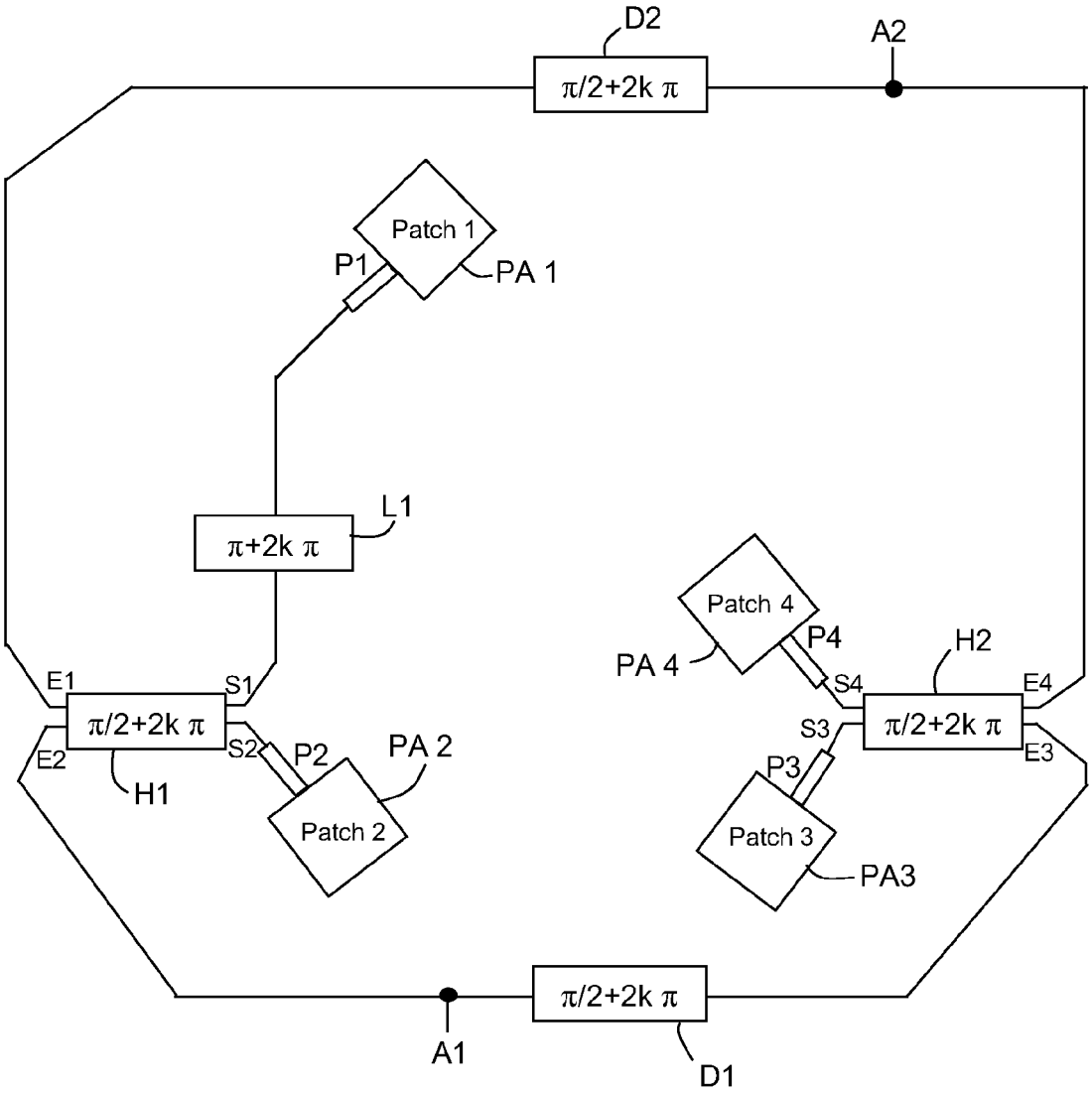
Figure 6:
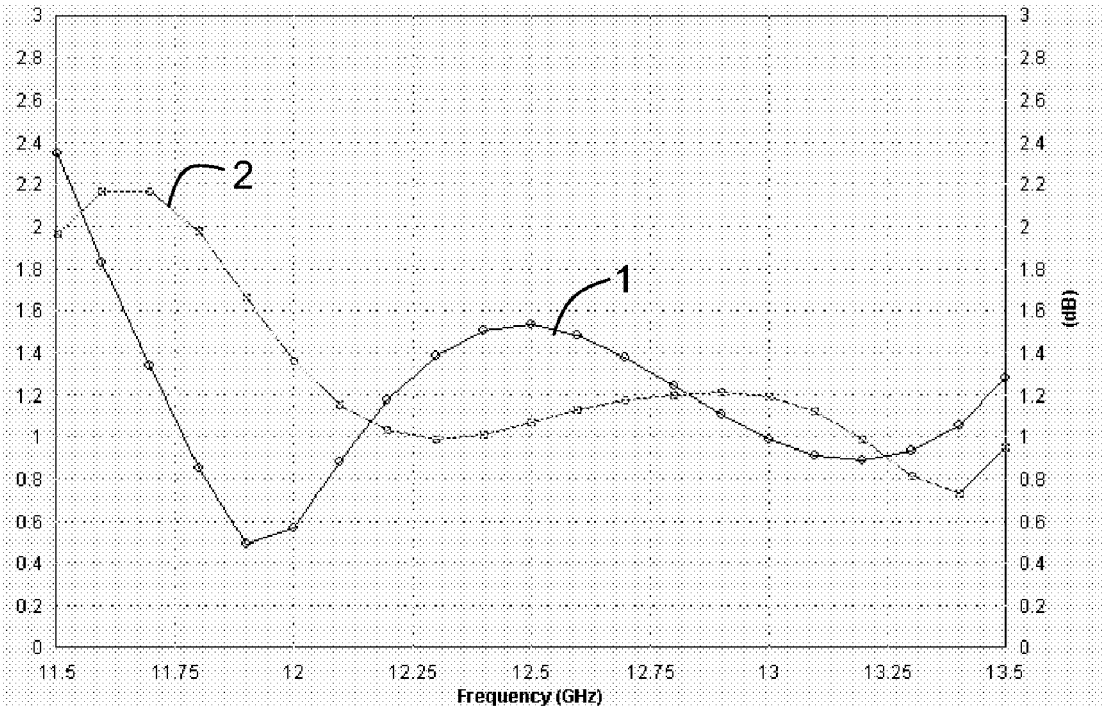

The characteristics and advantages of the invention mentioned above, as well as others, will appear more clearly on reading the following description, offered in conjunction with the attached drawings, in which:

FIG. 1 already described, represents the network for excitation of an antenna network according to the state of the art;

FIGS. 2*a*, 2*b* and 2*c* represent various configuration diagrams for the radiating elements (patches);

FIG. 3 represents the theoretical configuration on which the invention is based;

FIG. 4*a* represents the design of a system according to the invention;

FIG. 4*b* represents a theoretical configuration of the invention;

FIG. 5 and FIG. 6 represent the charts illustrating proper operation of the system;

The circuit according to the state of the art having been briefly described previously it will not be redescribed subsequently.

The circular polarization is obtained, for example, by a method known to the person skilled in the art which consists in taking radiating elements with mutually orthogonal linear polarization and in exciting them in phase quadrature.

On a single radiating element of patch type it therefore suffices to excite by two ports the two orthogonal sides and to impose a phase difference of 90° between them to produce a circular polarization. The cross polarization will be obtained by the inversion of the phase difference between the ports.

With two patches, it suffices to excite each patch such that their excitations are orthogonal and that the phase shift between the ports is 90°.

Moreover so as to improve the bandwidth of said network, the technique of sequential rotation is used. FIG. 2*a* takes up the basic diagram of this technique. Each of the 4 patches PA1, PA2, PA3, and PA4 is excited. The excitations are orthogonal and the phase shift between each port is 90°.

But the mechanical constraints of the invention entail that it is necessary to leave physical room at the center of the array for the other K/Ka source, which may for example be a horn-shaped source.

By a geometric adjustment it is possible easily to rotate the radiating elements so that they present a side rather than a corner so as to free to the maximum the room at the center of the patch array.

FIG. 2*b* represents the configuration diagram for these patches PA1, PA2, PA3, and PA4. The ports are orthogonal and the phase differences between each port are 90°.

It is on this geometric basis of the 4 patches represented by FIG. 2*b* that the excitation network for generating the dual circular polarization is constructed so as to leave room at the center of the structure for a second colocalized source as represented by FIG. 2*c*.

To generate the dual circular polarization, it is therefore necessary to have two directions of rotation of the phases on the 4 ports:

If for the first polarization to the port P1 of the patch PA1 there corresponds a phase of 0°, to the port P2 of the patch PA2 there corresponds a phase of 90°, to the port P3 of the patch PA3 there corresponds a phase of 180° and to the port P4 of the patch PA4 there corresponds a phase of 270°, then for the second polarization, the direction of rotation of the phases being inverted, to the port P1 there corresponds a phase of 0°, to the port P2 there corresponds a phase of −90°, to the port P3 there corresponds a phase of −180° and to the port P4 there corresponds a phase of −270°.

FIG. 3 represents the theoretical configuration on which the invention is based.

Specifically, to generate a phase shift of 90° between two ports it is necessary to use a conventional hybrid coupler dimensioned to the central frequency of the specified frequency band of interest (here 12.5 GHz). Therefore to perform the first polarization by an excitation of the input port A1, two hybrid couplers H1 and H2 will be respectively placed between the ports P1 and P2, and P3 and P4 in the following manner: the output S1 of the first hybrid coupler H1 is linked to the port P1 of the radiating element PA1 while its output S2 is linked to the port P2 of the radiating element PA2. A phase shift is thus respectively generated between the outputs S1 and S2 and the inputs E2 and E1. With such an arrangement if the port P1, linked to the output of the coupler H1, is excited by a signal on the input port A1, the phase of patch 1 is 0°, and that of patch 2 is 90°. Likewise the output S3 of the second hybrid coupler H2 is linked to the port P3 of the radiating element PA3 while its output S4 is linked to the port P4 of the radiating element PA4. It thus generates a phase shift between the outputs S3 and S4 and the inputs E3 and E4 of the hybrid coupler H2 respectively. To obtain the first circular polarization, it is therefore necessary to excite the port P3 with a phase shift of $\pi$, afforded by the phase shift element D1, with respect to the port P1. The phase of patch 3 will therefore be 180° and that of patch 4 will be 270° in the light of the hybrid coupler H2 placed between the ports P3 and P4.

To obtain the second polarization, the port P2, linked to the output of the coupler H1, is excited by a signal on the input port A2 and the phase of patch 2 is 0°, that of patch 1 is consequently 90°. It is therefore necessary to excite the port P4 with a phase shift of $\pi$, afforded by the phase shift element D2, with respect to the port P2. The phase of patch 4 will therefore be 180° and that of patch 3 will be 270° in the light of the hybrid coupler H2 placed between the ports P3 and P4.

The theoretical configuration shows that the excitation lines due to the attachment of P1 and P3 by a phase shift element and of P2 and P4 by another phase shift element cross one another.

But this crossing which involves passing the lines one above another, entails significant losses as well as a very large risk of deterioration of the amplitudes and phases between the ports.

The invention is aimed at avoiding this crossing.

The principle of the invention, whose design is represented by FIG. 4*a* and a theoretical configuration by FIG. 4*b*, therefore consists in placing between the first hybrid H1 and the patch 1*a* line length L1 such that it makes it possible to generate the two orthogonal circular polarizations as a function of the selected ports.

If we take into account all the phase shifts introduced into the various paths as well as the components of fields generated by the various patches to produce the dual circular polarization and with the aid of electromagnetic simulation software (IE3D-Zeland), the results obtained, after optimizations of the various parameters of the structure, impose certain constraints for this line length.

The first constraint is a constraint in relation to the hybrid selected. The phase shift introduced between the hybrids must be equal to the phase shift of the hybrid modulo $2k\pi$, k integer. The phase shift of a conventional hybrid being 90° in the theoretical configuration represented by FIG. 4*b*, accordingly the phase shift between the hybrids will be 90°.

The second constraint is a constraint in relation to the length of the line L1 placed between the first hybrid H1 and the first patch PA1.

The line length must be such that the phase shift between the hybrid H1 and the first patch is equal to π modulo 2kπ, k integer.

FIG. 4*a* representing an example of the design of a system according to the invention shows that the 4 patches are positioned so as to leave the central zone free so as to introduce, for example, the Ka source centered in the shape of a ring or any other shape allowing its insertion into this central zone. The patch PA1 is linked to the hybrid element H1 by way of the line L1 of length allowing a phase shift equal to π modulo 2kπ, k integer.

The other patches are linked directly to the hybrid elements as described previously. Phase shift elements formed by the connection lines and by the elements D1 and D2 are placed between the ports P3 and P2 and between the ports P1 and P4. The two ports A1 and A2 allow linking of the system according to the invention with the reception chain.

The person skilled in the art knows how to optimize the length of a line as a function of each topology concerned, such as for example microstrip lines or waveguides or coplanar lines or coaxial lines.

By way of exemplary embodiment, for a Microstrip type line with phase shift 180° on a Rogers 4003 substrate, having a permittivity of 3.38 and with a height of the substrate of 0.81 mm, a "design" frequency of 12 GHz and an impedance of 50 ohms, and of calculated track width of 1.98 mm, the length of the track is 7.38 mm.

FIG. 4*b* represents a theoretical configuration of the invention. The addition of the line L1 of phase shift π+2kπ makes it possible to avoid the crossing of the connection lines between the ports P1 and P4 and the ports P2 and P3 while preserving the generation of orthoganal circular polarizations. The calculation of the phase shift associated with each patch shows a phase shift of 90° between the orthogonal components, this therefore corresponding to a circular polarization.

Specifically with a first polarization, corresponding to an excitation signal on the port A1, a phase shift of 0° is associated with the port P2 of the patch PA2.

The phase shift associated with the port P1 of the patch PA1 corresponds to the sum of the phase shift of π/2 due to the hybrid and of the phase shift of π due to the line L1, i.e. 3 π/2.

The phase shift associated with the port P3 of the patch PA3 corresponds to the phase shift of π/2 due to the line D1.

The phase shift associated with the port P4 of the patch PA1 corresponds to the sum of the phase shift of π/2 due to the hybrid and of the phase shift of π/2 due to the line D1, i.e. π.

Likewise at a second polarization, corresponding to an excitation signal on the port A2, the calculation shows a phase shift of π/2 between the orthogonal components, this therefore corresponding to a circular polarization.

FIGS. 5 and 6 represent the charts illustrating the proper operation of the device according to the invention.

The chart according to FIG. 5 represents the parameters Sij which are the image of the electrical performance of the antenna as a function of frequency. The curve representing the evolution of the parameters S11, relating to the port 1, as a function of frequency indicates a reflection coefficient of less than −20 dB over the whole bandwidth, thereby indicating maximum energy transfer.

Likewise the curve representing the evolution of the parameter S22, relating to the port 2, as a function of frequency indicates a reflection coefficient of less than −20 dB over the whole bandwidth, thereby also indicating maximum energy transfer.

The parameter S12 is representative of the isolation between the two ports. The lower this parameter the better is the isolation between the ports. The curve shows that for the frequencies of less than 13.25 GHz the isolation is less than −10 dB, which implies that there will be only little "pollution" between the two reception pathways. In the 12.6 GHz-12.8 GHz frequency band, the isolation reaches −20 dB thereby corresponding to the performance sought. The chart according to FIG. 6 represents the ellipticity ratio (Axial Ratio) as a function of frequency, said ratio is representative of the quality of the circular polarization, it can be expressed in dB or in linear. An ellipticity ratio of 0 dB signifies perfect circular polarization, a higher ellipticity ratio tends towards increasingly elliptical polarization, the extreme being a very large ellipticity ratio (>10 dB) in the case of linear polarization. This ellipticity ratio takes account of the phase difference of the two orthogonal components of the field and also of the amplitude difference of these two components.

The ellipticity ratio of the complete network is less than 1.74 dB in the direction of the main radiation over the whole bandwidth of interest.

Other variants of the invention are envisageable.

The antenna array comprising two pairs of radiating elements distributed so as to free the center of the array therefore allows the reception of at least two frequency bands by at least two antennas. It is therefore possible to effect antenna diversity reception in the same frequency band by using two antennas of different type or of the same type in the same frequency band. The second antenna is situated at the center of the array. The different types of antennas can for example be "horn" type antennas and "polyrod" type antennas.

The examples previously described show patches of quadratic shape. Other shapes, such as circular or orthogonal can be envisaged.

The separation between the patches is represented symbolically. It can be optimized for each embodiment.

The excitation of the patches can be done in different ways either by way of microstrip lines, or by rectangular-shaped or cross-shaped slot for example, or else by electromagnetic coupling.

The invention claimed is:

1. Network of antennas for reception of a first and a second frequency bands comprising:

a first and a second pairs of square radiating elements arranged in a square area, with geometric centers of the radiating elements at the corner of the square area and sides of each radiating element being parallel to the sides of the square area, the first pair comprising a first radiating element and a second radiating element; and a network of excitation of the radiating elements of the first and second pairs for the reception the first frequency bands comprising:

a first hybrid coupler including two inputs and two outputs, of which each of the outputs is connected respectively to each radiating element of the first pair and allowing to generate a phase shift π/2 of between the radiating elements;

a second hybrid coupler including two inputs and two outputs, of which each of the outputs is connected respectively to each radiating element of the second pair and allowing to generate a phase shift of $\pi/2$ between the radiating elements;

a first phase shifter D1 generating a difference of phase of $\pi/2$ between the first inputs of the hybrid couplers;

a second phase shifter generating a difference of phase of $\pi/2$ between the second inputs of the hybrid couplers;

wherein the square radiating elements are turned of $\pi/4$ relating to vertical axis in order to free the center of the excitation network allowing a colocalized reception of the second frequency band by a source occupying the center of the said network; and an element of phase shift of $\pi$0 is inserted before the first radiating element, allowing a double circular polarization.

2. The antenna array as claimed in claim 1 wherein the first and the second frequency bands of the antenna array are the KU and KA bands.

* * * * *